US011406866B2

(12) United States Patent
Chen

(10) Patent No.: US 11,406,866 B2
(45) Date of Patent: Aug. 9, 2022

(54) EXERCISE DEVICE FOR DEEP SQUAT AND BODY STRETCH

(71) Applicant: ZHONGSHAN YINGLIANG HEALTH TECHNOLOGY CO., LTD., Zhongshan (CN)

(72) Inventor: Yi-Tzu Chen, Taoyuan (TW)

(73) Assignee: Zhongshan Yingliang Health Technology Co., Ltd., Guangdong Province (CN)

( * ) Notice: Subject to any disclaimer, the term of this patent is extended or adjusted under 35 U.S.C. 154(b) by 123 days.

(21) Appl. No.: 17/091,307

(22) Filed: Nov. 6, 2020

(65) Prior Publication Data

US 2022/0143458 A1 May 12, 2022

(51) Int. Cl.
*A63B 23/04* (2006.01)
*A63B 21/00* (2006.01)
(Continued)

(52) U.S. Cl.
CPC ..... *A63B 23/0405* (2013.01); *A63B 21/0087* (2013.01); *A63B 21/4034* (2015.10);
(Continued)

(58) Field of Classification Search
CPC ..... A47C 9/002; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/008; A63B 21/0083; A63B 21/0085; A63B 21/0087; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/15;
(Continued)

(56) References Cited

U.S. PATENT DOCUMENTS 3,964,742 A * 6/1976 Carnielli ..... A61H 1/0214 601/36
4,509,742 A * 4/1985 Cones ..... A63B 22/0605 138/45
(Continued)

FOREIGN PATENT DOCUMENTS

CN 208541737 U 2/2019
CN 210495080 U 5/2020
JP 2021019852 A 2/2021

*Primary Examiner* — Gary D Urbiel Goldner
(74) *Attorney, Agent, or Firm* — Rosenberg, Klein & Lee

(57) ABSTRACT

An exercise device for deep squat and body stretch has a device body, a damping assembly, and a pedal set. The device body has a base. The damping assembly is disposed on the base, and has a tube, a pneumatic cylinder which has multiple positioning through holes, and a seat. The pneumatic cylinder is mounted in the tube. An adjusting component is able to extend through the tube and is mounted with one of the positioning through holes. The seat is connected to the pneumatic cylinder for height adjustment. The pedal set is assembled on the device body, and has two pedals rotatably mounted on the device body.

10 Claims, 8 Drawing Sheets

(51) Int. Cl.

| | |
|---|---|
| ***A63B 21/008*** | (2006.01) |
| ***A63B 71/06*** | (2006.01) |
| ***A63B 24/00*** | (2006.01) |
| ***A63B 23/00*** | (2006.01) |

(52) U.S. Cl.
CPC ..... *A63B 21/4035* (2015.10); *A63B 21/4047* (2015.10); *A63B 24/0062* (2013.01); *A63B 71/0622* (2013.01); *A63B 2023/006* (2013.01); *A63B 2023/0411* (2013.01); *A63B 2071/065* (2013.01); *A63B 2220/16* (2013.01); *A63B 2220/833* (2013.01)

(58) Field of Classification Search
CPC . A63B 21/158; A63B 21/159; A63B 21/1609; A63B 21/4027; A63B 21/4029; A63B 21/4031; A63B 21/4033; A63B 21/4034; A63B 21/4035; A63B 21/4045; A63B 21/4047; A63B 22/0046; A63B 22/16; A63B 22/18; A63B 22/04; A63B 22/0411; A63B 2023/006; A63B 23/035; A63B 23/03516; A63B 23/03533; A63B 23/03541; A63B 23/04; A63B 23/0405; A63B 23/08; A63B 23/085; A63B 24/0062; A63B 71/0054; A63B 71/0619; A63B 71/0622; A63B 2071/0063; A63B 2071/0072; A63B 2071/065; A63B 2208/0204; A63B 2208/0209; A63B 2220/10; A63B 2220/16; A63B 2220/83; A63B 2220/833; A63B 2225/09; A63B 2225/093; A63B 2225/10
See application file for complete search history.

(56) References Cited

U.S. PATENT DOCUMENTS

| | | | | | |
|---|---|---|---|---|---|
| 4,750,735 | A * | 6/1988 | Furgerson | A63B 22/0076 | 482/901 |
| 4,783,068 | A | 11/1988 | Fahey | | |
| 5,232,421 | A * | 8/1993 | Chen | A63B 22/0056 | 482/53 |
| 5,312,311 | A * | 5/1994 | Pearson | A63B 71/0009 | 601/36 |
| 8,083,650 | B2 * | 12/2011 | Ozawa | A63B 21/00181 | 482/52 |
| 2012/0202653 | A1 * | 8/2012 | Seastrom | A63B 71/0622 | 482/57 |
| 2016/0296794 | A1 * | 10/2016 | Land | A63B 23/04 | |
| 2017/0001064 | A1 * | 1/2017 | Vorozilchak | A63B 21/4047 | 482/901 |
| 2019/0192902 | A1 * | 6/2019 | Chen | A63B 21/0552 | |
| 2020/0376327 | A1 * | 12/2020 | Bissonnette | A63B 23/03575 | |

* cited by examiner

EXERCISE DEVICE FOR DEEP SQUAT AND BODY STRETCH

BACKGROUND OF THE INVENTION

1. Field of the Invention

The present invention relates to an exercise device, and more particularly to an exercise device facilitating a user to perform deep squat and body stretch.

2. Description of Related Art

Several kinds of conventional exercise devices are provided on the market. The conventional exercise devices can be designed and manufactured for training different portions of a user's body, respectively. Thus some of the conventional exercise devices can be only used for training a specific portion of the user's body, and the user's need of training multiple portions of the body cannot be satisfied by one single kind of the conventional exercise devices.

Although another kind of the conventional exercise devices is multifunctional and can be used to train multiple portions of the user's body, this kind of the conventional exercise device has a complex structure, which makes it expensive and inconvenient for use.

SUMMARY OF THE INVENTION

The main objective of the present invention is to provide an exercise device that is simple in configuration and easy to operate. A user's two legs can be stretched one after the other one, the user can step on two pedals of the exercise device and swing the user's feet for stretching the two legs, or the user can sit to do deep squat.

The exercise device for deep squat and body stretch comprises a device body, a damping assembly, a pedal set, and two angle sensors. The device body has a base and two handles. The damping assembly has a tube, a pneumatic cylinder, and a seat. The tube is mounted uprightly on the base and has a side wall, an interior space formed inside the side wall of the tube, two ends, a positioning socket, an adjusting component, and a guiding slot. One of the two ends of the tube is connected to the base, and the other one of the two ends of the tube has an opening. The positioning socket is disposed on the side wall of the tube and communicates with the interior space. The adjusting component is mounted with the positioning socket, has two ends, and one of the two ends of the adjusting component extends into the interior space. The guiding slot is disposed on the side wall of the tube and communicates with the interior space. The pneumatic cylinder is inserted into the tube, and has a cylinder body and a piston rod. The cylinder body has a side wall, multiple positioning through holes, and a guiding post. The multiple positioning through holes are disposed on the side wall of the cylinder body, and are arranged in an axial direction of the cylinder body, wherein the adjusting component of the tube is configured to be mounted with one of the multiple positioning through holes. The guiding post protrudes on the side wall of the cylinder body and extends into the guiding slot. The piston rod has a free end, and the seat is connected to the free end of the piston rod.

The pedal set has a supporting stand, an axle, a first supporting rod, a second supporting rod, a first pedal, a second pedal, and multiple elastic rings. The supporting stand is connected to the base. The axle is assembled on the supporting stand, and has two ends. The first supporting rod protrudes from the base below one of the two ends of the axle. The second supporting rod protrudes from the base below the other one of the two ends of the axle. The first pedal is mounted to the axle, and has a first pedal rod. The second pedal is mounted to the axle, and has a second pedal rod. At least one of the multiple elastic rings is connected between the first supporting rod and the first pedal rod, and at least another one of the multiple elastic rings is connected between the second supporting rod and the second pedal rod. One of the two angle sensors is mounted on the first pedal rod at a spaced interval from the axle, and the other angle sensor is mounted on the second pedal rod at a spaced interval from the axle.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
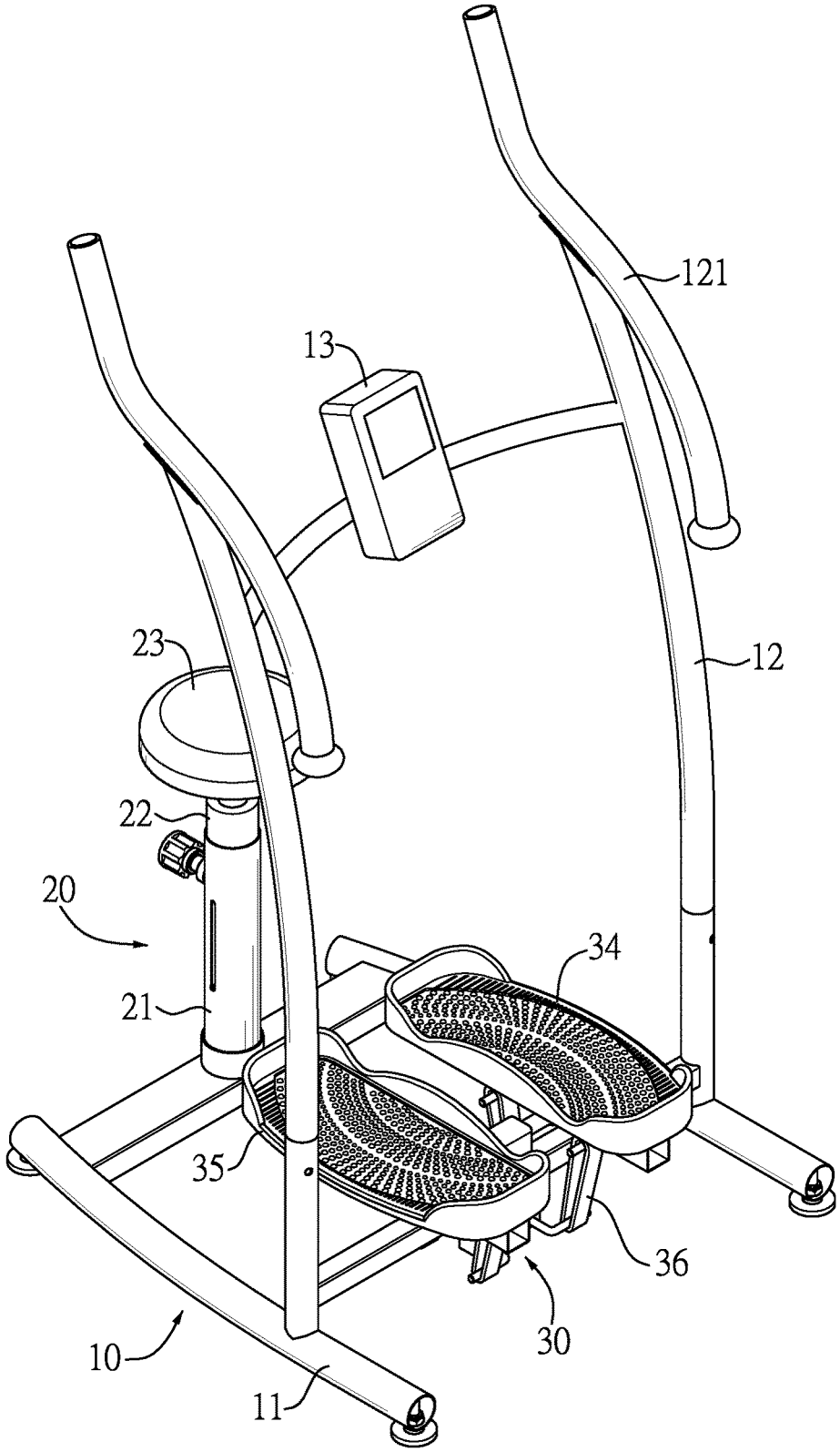
FIG. 1 is a perspective view of an exercise device for deep squat and body stretch in accordance with the present invention.
Figure 2:
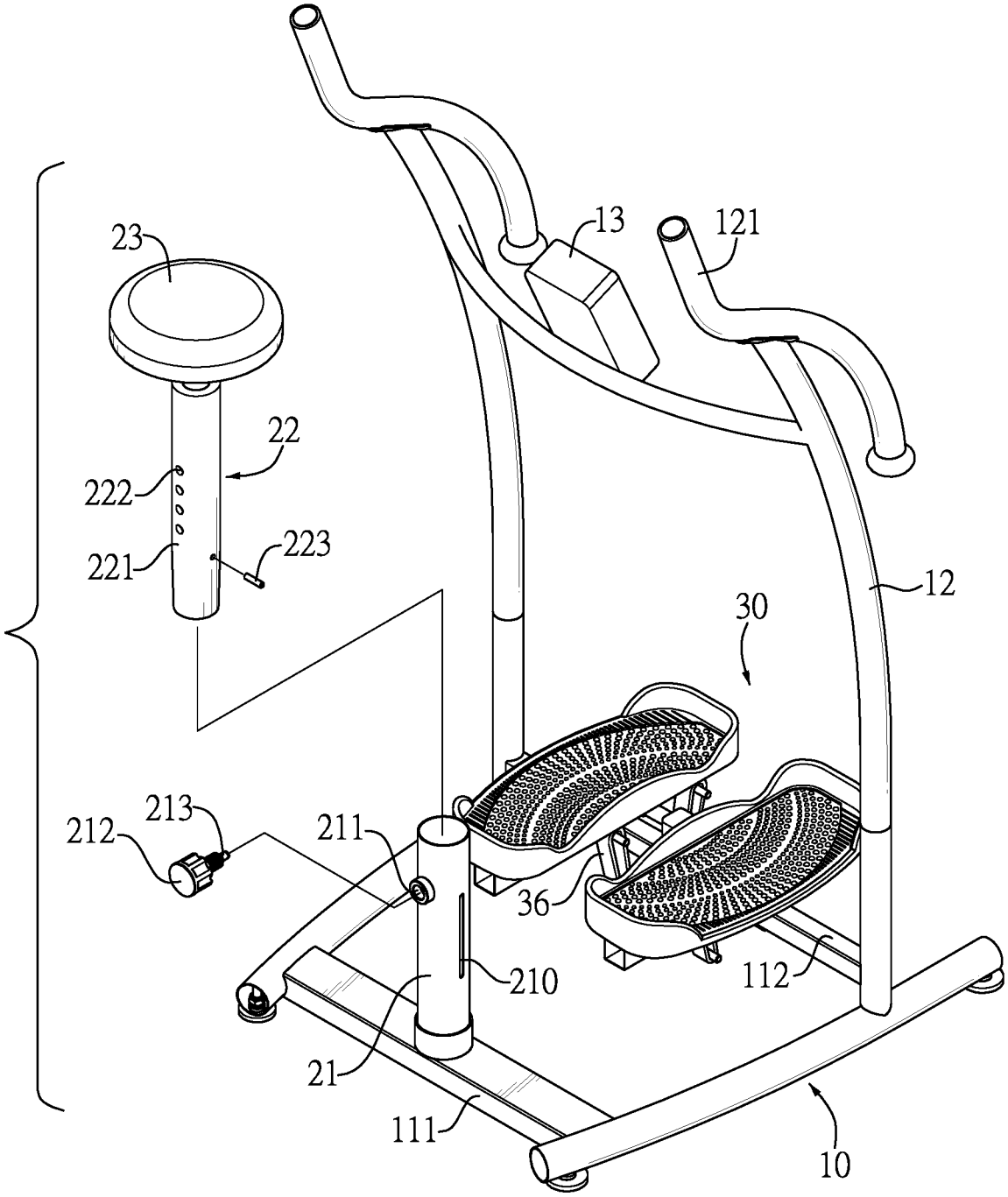
FIG. 2 is an exploded perspective view of the exercise device for deep squat and body stretch in FIG. 1.
Figure 3:
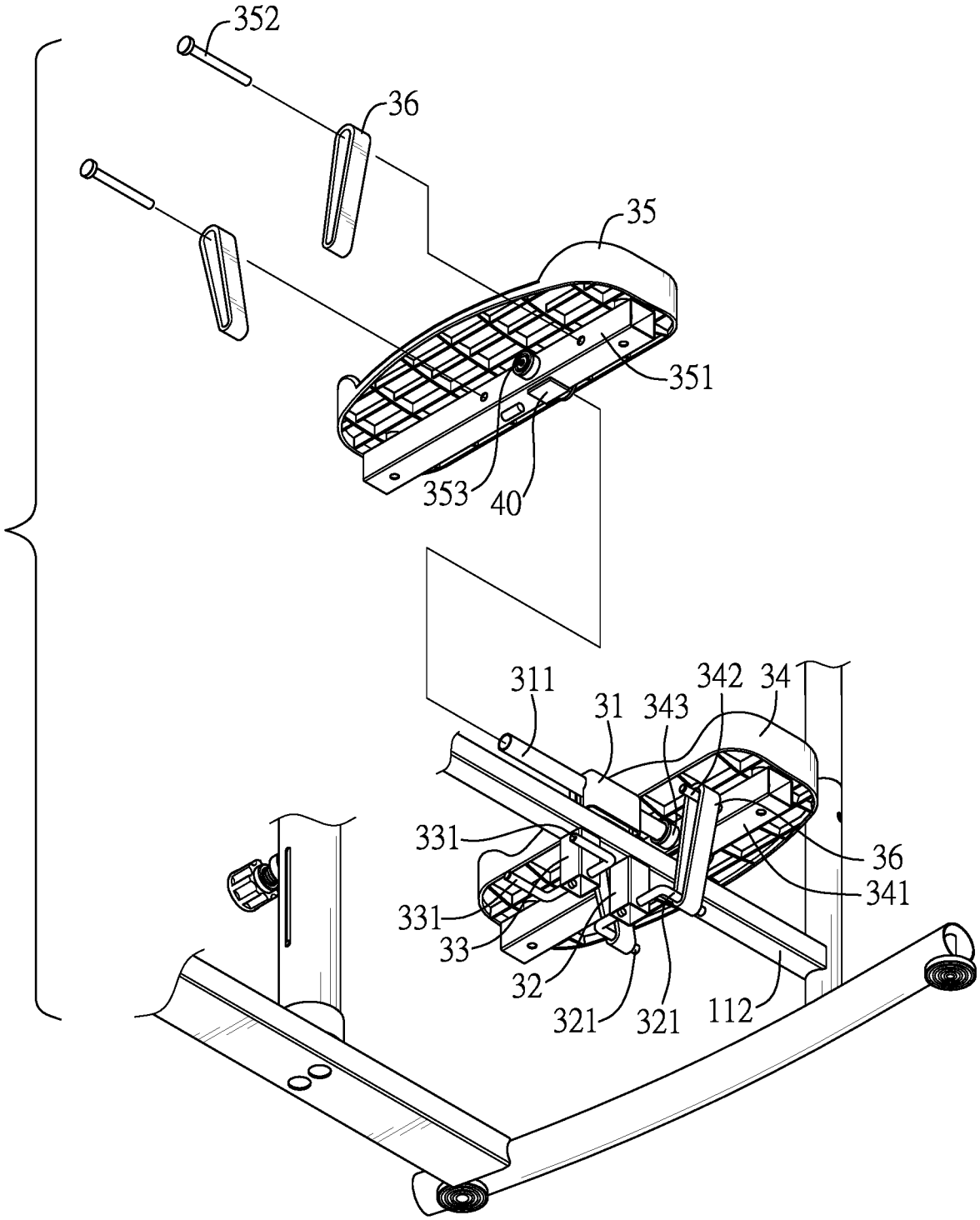
FIG. 3 is an exploded perspective view of a pedal set of the exercise device for deep squat and body stretch in FIG. 1.

With reference to FIGS. 1 to 3, an exercise device for deep squat and body stretch in accordance with the present invention comprises a device body 10, a damping assembly 20, a pedal set 30, and two angle sensors 40.

With reference to FIG. 2, the device body 10 is a frame, and has a base 11 and a standing frame 12. The base 11 has a front side, a rear side, a front bar 111, and a rear bar 112. The front bar 111 is located at the front side of the base 11, the rear bar 112 is located at the rear side of the base 11, and the rear bar 112 and the front bar 111 are disposed at a spaced interval. The rear bar 112 has a top side and a bottom side. The standing frame 12 is mounted uprightly on the base 11, and has two handles 121. The two handles 121 are each respectively connected to two sides of the base 11. Moreover, the standing frame 12 has a display 13. When a user is exercising on the exercise device, the display 13 may display the user's physiological information and/or related data. The technique about the display 13 is a prior art, so detailed description thereof is omitted.

The damping assembly 20 has a tube 21, a pneumatic cylinder 22, and a seat 23. The tube 21 is hollow, and has a side wall, an interior space formed inside the side wall of the tube 21, two ends, a positioning socket 211, an adjusting component, and a guiding slot 210. One of two ends of the tube 21 is fixed to the front bar 111 of the base 11, and the other end of the tube 21 has an opening. The positioning socket 211 is disposed on the side wall of the tube 21. The adjusting component is mounted with the positioning socket 211, and extends into the interior space of the tube 21. In a preferred embodiment of the present invention, the positioning socket 211 has a threaded hole formed therethrough, and the adjusting component is an adjusting bolt 212, so the adjusting bolt 212 may be screwed with the threaded hole of the positioning socket 211. The adjusting bolt 212 has two ends and a positioning post 213 connected to one of the two ends of the adjusting bolt 212. The positioning post 213 may extend into the tube 21. The adjusting bolt 212 may be extracted from the tube 21. The guiding slot 210 is disposed on the side wall of the tube 21, and communicates with the interior space of the tube 21.

Figure 4:
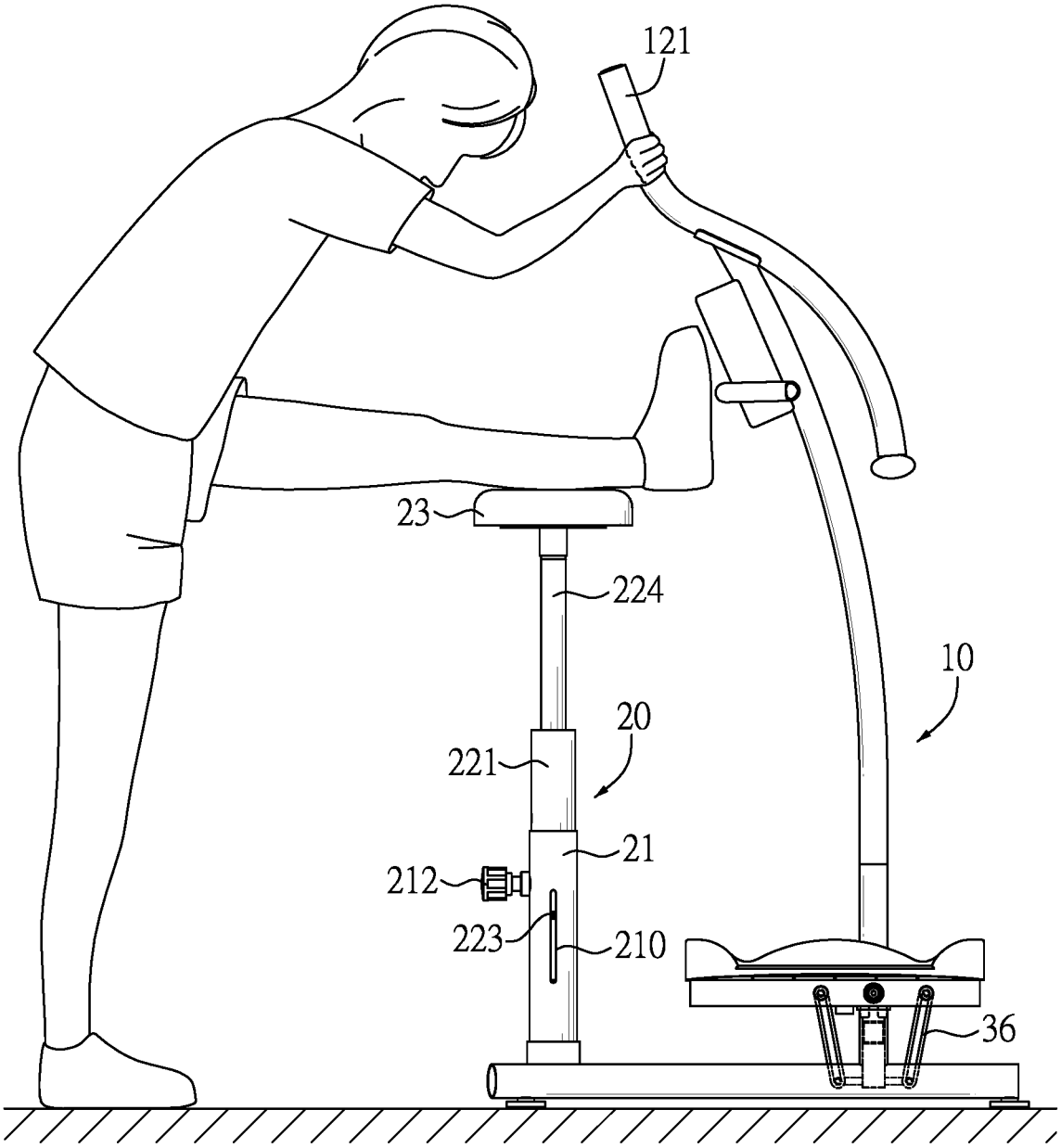
FIG. 4 is an operational side view of the exercise device for deep squat and body stretch in FIG. 1, showing a first mode of operation.

With reference to FIGS. 2 to 4, the pneumatic cylinder 22 has a cylinder body 221 and a piston rod 224. The cylinder body 221 is inserted into the tube 21, and has a side wall, multiple positioning through holes 222, and a guiding post 223. The multiple positioning through holes 222 are disposed on the side wall of the cylinder body 221 and arranged in an axial direction of the cylinder body 221 at spaced intervals. The guiding post 223 protrudes on the side wall of the cylinder body 221, and extends into the guiding slot 210. The guiding post 223 is slidable in the guiding slot 210, so the cylinder body 221 can slide up and down. As the cylinder body 221 moves, the adjusting bolt 212 may be aligned with one of the multiple positioning through holes 222 of the cylinder body 221, and when the adjusting bolt 212 is mounted with the positioning socket 211, the positioning post 213 of the adjusting bolt 212 can be stuck into the aligned positioning through hole 222. Through this operation process, the user may adjust a height of the seat 23. The piston rod 224 has an end extending into the cylinder body 221 and a free end. Gas is filled between the piston rod 224 and the cylinder body 221, so the piston rod 224 may slide up and down against the cylinder body 221, with or without an external force. Working principles of the pneumatic cylinder 22 are conventional, so detailed description thereof is omitted. The seat 23 is connected to the free end of the piston rod 224.

With reference to FIGS. 3 and 4, the pedal set 30 has a supporting stand 31, an axle 311, a first supporting rod 32, a second supporting rod 33, a first pedal 34, a second pedal 35, and multiple elastic rings 36. The support stand 31 is fixed on the top side of the rear bar 112 of the base 11. The axle 311 is assembled on the supporting stand 31, and has two ends. The first supporting rod 32 is connected to the bottom side of the base 11 below one of the two ends of the axle 311, and the second supporting rod 33 is connected to the bottom side of the base 11 below the other one of the two ends of the axle 311. The first supporting rod 32 has two first hitching bars 321, and each one of the first hitching bars 321 is disposed on a respective one of a front side and a rear side of the first supporting rod 32. The second supporting rod 33 has two second hitching bars 331, and each one of the second hitching bars 331 is disposed on a respective one of a front side and a rear side of the second supporting rod 33. With reference to FIG. 3, in the preferred embodiment, the two first hitching bars 321 and the two second hitching bars 331 are L-shaped bars.

The first pedal 34 has a first pedal rod 341 mounted on a bottom side of the first pedal 34. The first pedal rod 341 has an axle socket 343 and two first connecting bars 342. The axle socket 343 of the first pedal rod 341 is located between the two first connecting bars 342, and is pivotally mounted with one of the two ends of the axle 311. The second pedal 35 has a second pedal rod 351 mounted on a bottom side of the second pedal 35. The second pedal rod 351 has an axle socket 353 and two second connecting bars 352. The axle socket 353 of the second pedal rod 351 is located between the two second connecting bars 352, and is pivotally mounted with the other one of the two ends of the axle 311.

Two of the multiple elastic rings 36 are connected between the first supporting rod 32 and the first pedal rod 341, and each one of said two elastic rings 36 is sheathed on a respective one of the two first connecting bars 342 and a respective one of the two first hitching bars 321. Another two of the multiple elastic rings 36 are connected between the second supporting rod 33 and the second pedal rod 351, and each one of said another two elastic rings 36 is sheathed on a respective one of the two second connecting bars 352 and a respective one of the two second hitching bars 331. In the preferred embodiment of the present invention, there are four said above-mentioned elastic rings 36. However, the amount of the multiple elastic rings 36 may be easily adjusted upon practical demands. With aforementioned technical features, when the first pedal 34 and the second pedal 35 swing, resilient forces would be provided by the multiple elastic rings 36.

One of the two angle sensors 40 is mounted on the second pedal rod 351 of the second pedal 35, at a spaced interval from the axle socket 353 of the second pedal 35 and the axle 311. Once the second pedal 35 swings about the axle 311, the angle sensor 40 mounted with the second pedal 35 may detect an angle for which the second pedal 35 has rotated. The other one of the two angle sensors 40 is mounted on the first pedal rod 341 of the first pedal 34, at a spaced interval from the axle socket 343 of the first pedal 34 and the axle 311. Once the first pedal 34 swings about the axle 311, the angle sensor 40 mounted with the first pedal 34 may detect an angle for which the first pedal 34 has rotated. Furthermore, each one of the two angle sensors 40 is connected with the display 13 via wireless transmission or a signal line so as to transmit information about the sensed angles to the display 13, and the display 13 shows the information to the user. The working principles of the angle sensors 40 are conventional, and description thereof is therefore omitted.

With reference to FIGS. 1 and 4, in a first mode of operation of the exercise device for deep squat and body stretch, the user may adjust the height of the seat 23 through the method described above, stand on the ground with one leg, and put the other leg on the seat 23. With two hands holding the two handles 121, the user can easily stretch the legs by bending forward.

Figure 5:
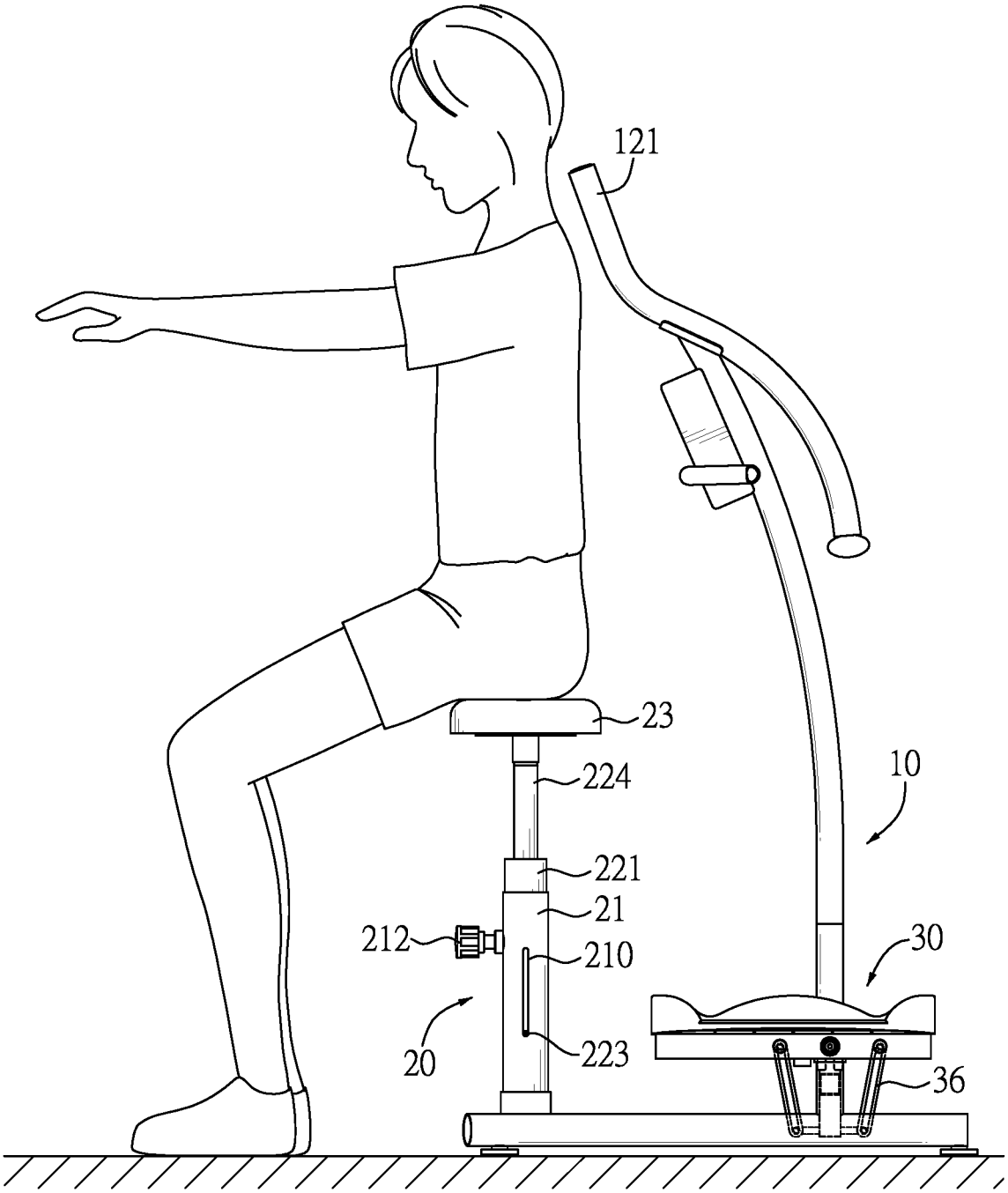
FIGS. 5 and 6 are operational side views of the exercise device for deep squat and body stretch in FIG. 1, showing a second mode of operation.
Figure 6:
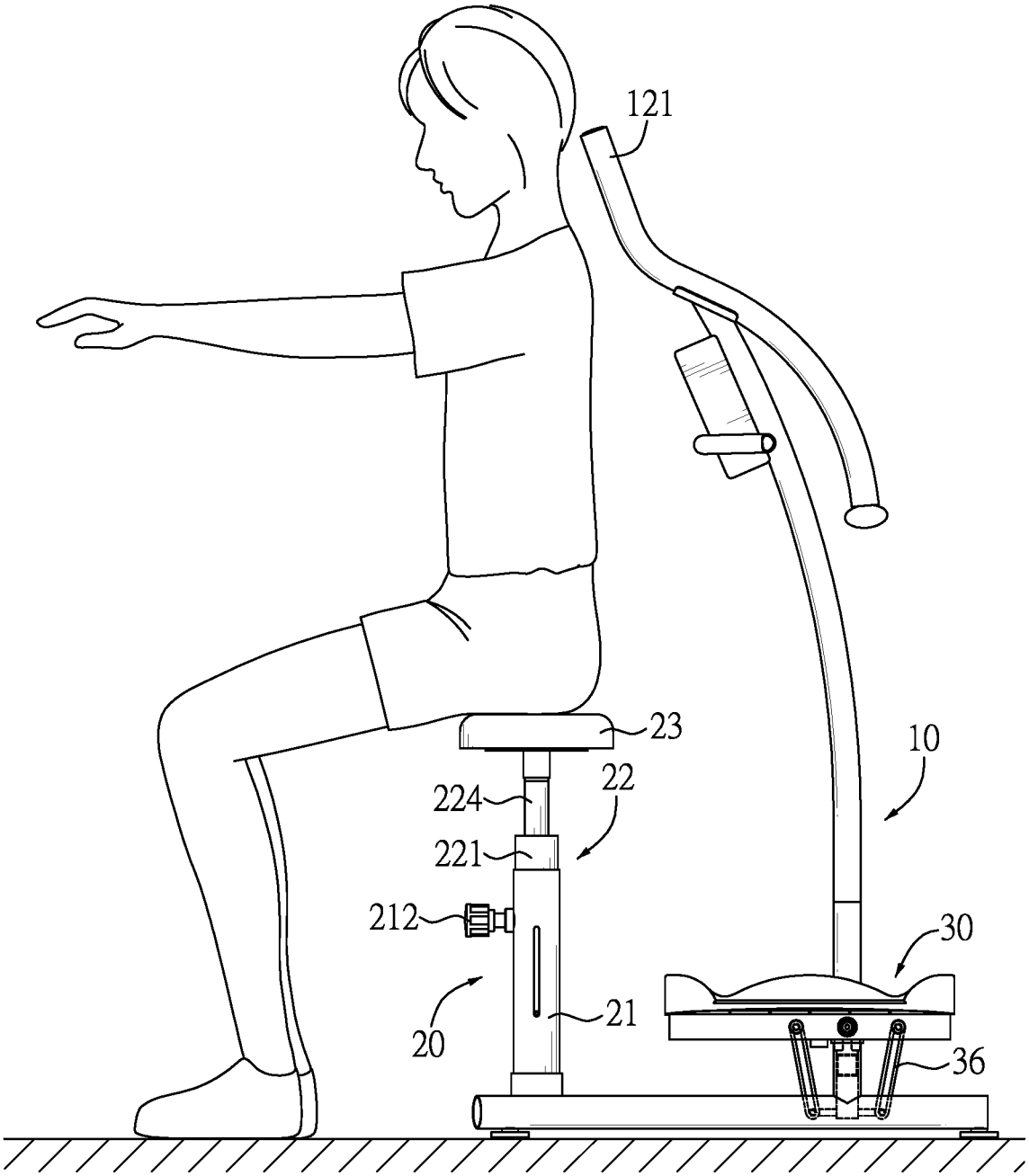

With reference to FIGS. 5 and 6, in a second mode of operation of the exercise device for deep squat and body stretch, the user may sit on the seat 23, and squat downward to overcome a resistant force of the pneumatic cylinder 22. As the user squats, the seat 23 is pushed downward. On the other hand, when the user treads to props up his body, the resilient force of the piston rod 224 of the pneumatic cylinder 22 pushes the seat 23 to move upward. The user may do several sets of deep squats by repeating the two movements, i.e. squatting down and propping up.

Figure 7:
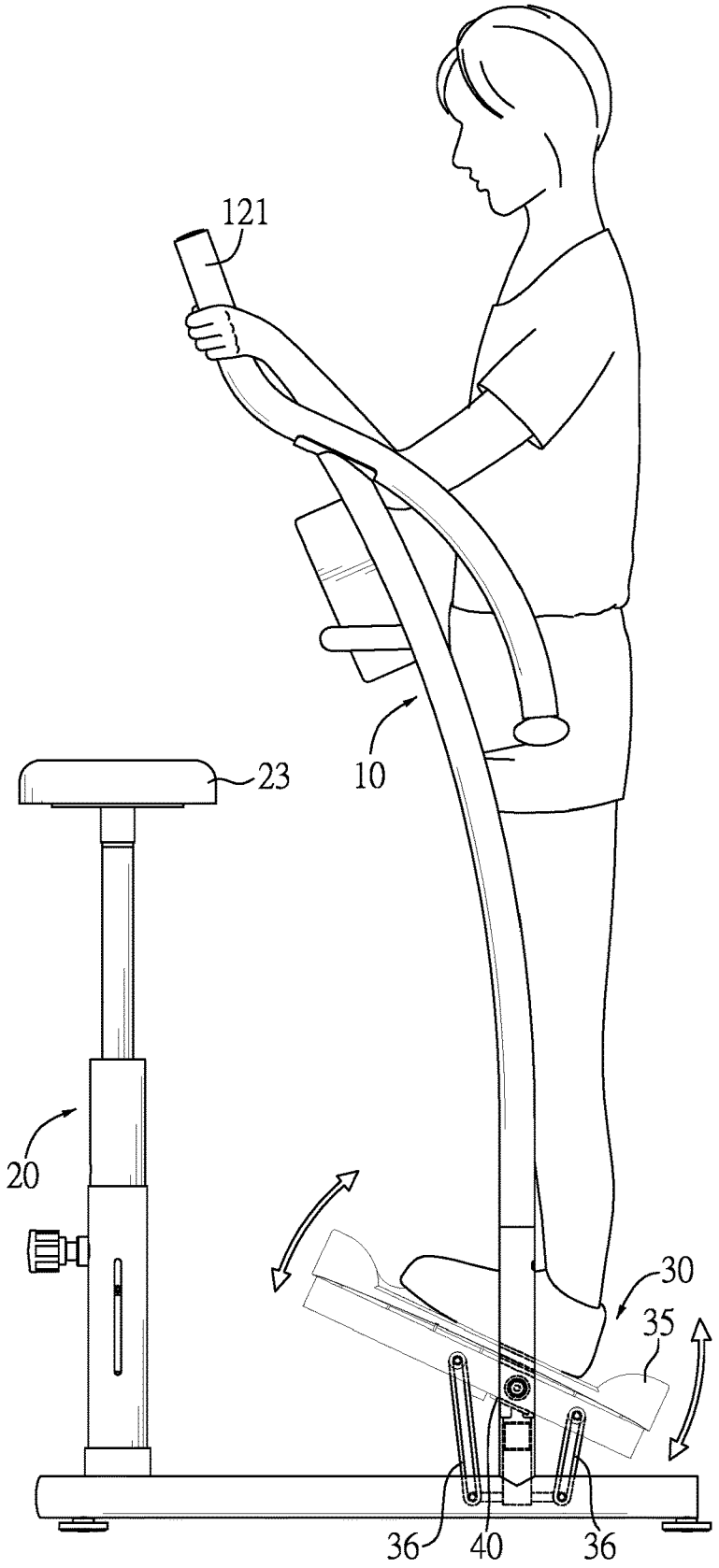
FIG. 7 is an operational side view of the exercise device for deep squat and body stretch in FIG. 1, showing a third mode of operation.

With reference to FIGS. 1 and 7, in a third mode of operation of the exercise device for deep squat and body stretch, the user may also step on the first pedal 34 and the second pedal 35, and hold the two handles 121 of the standing frame 12. The user may stamp two heels of his feet at the same time, so the two pedals 34, 35 tilt accordingly. In such position, forefeet of the user tilt upwardly and stretch the elastic rings 36 that are in the front side, and the user's two calves are stretched as a result.

Figure 8:
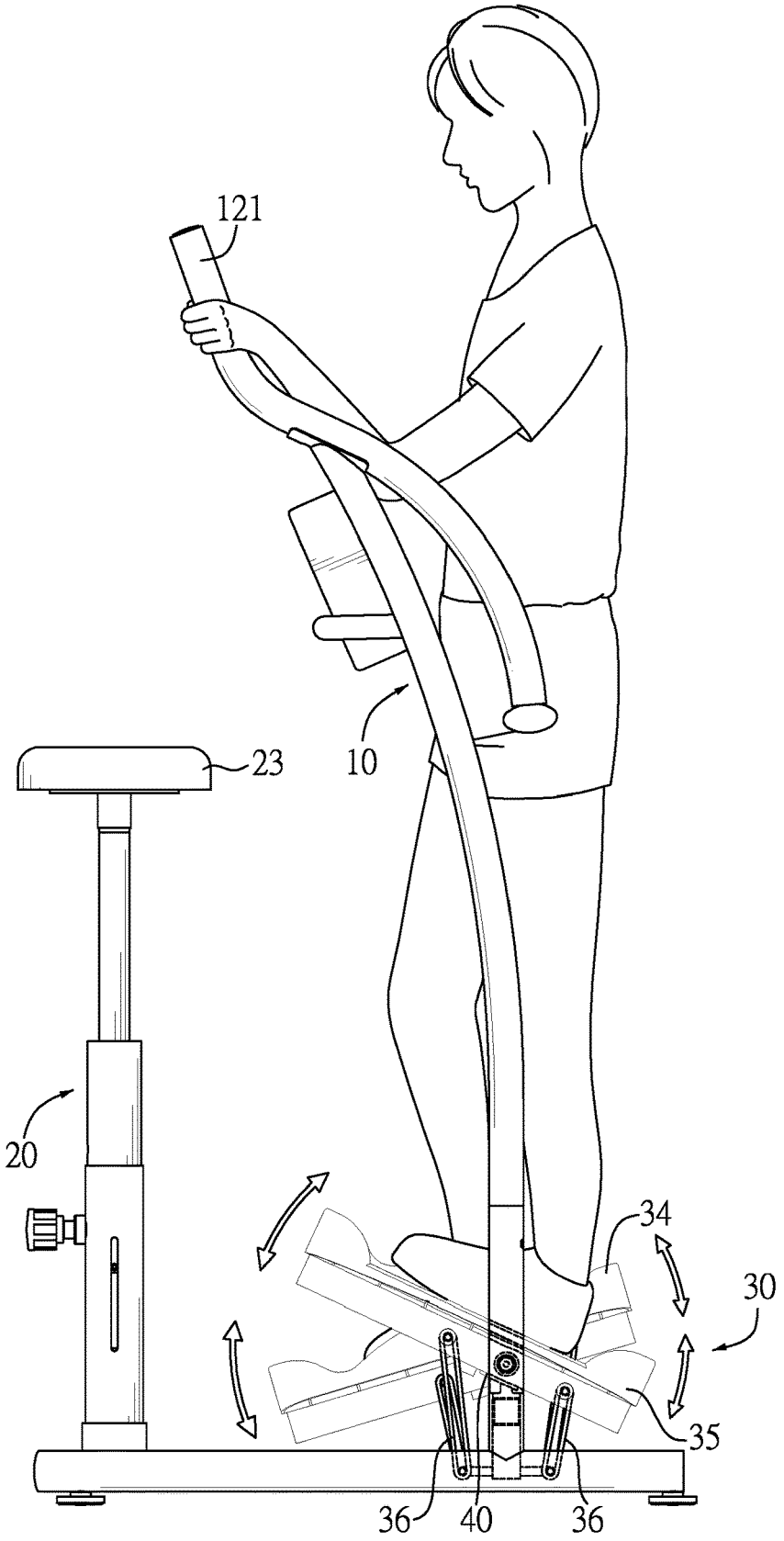
FIG. 8 is an operational side view of the exercise device for deep squat and body stretch in FIG. 1, showing a fourth mode of operation.

With reference to FIGS. 1 and 8, in a fourth mode of operation of the exercise device for deep squat and body stretch, the user stamps down the left heel and stamps down the right forefoot. In this way, only the second pedal 35 acts in the way as shown in FIG. 7, the elastic rings 36 on the left side are stretched, and only the left calf of the user is stretched. Afterwards, the user may switch the motions of the two feet, so as to stretch the right calf.

With the aforementioned technical features, the exercise device for deep squat and body stretch in accordance with the present invention has the following advantages.

1. The seat 23 may be easily and rapidly adjusted in height upon the user's demand, so the user may put one of the legs on the seat 23 for stretching, or the user may sit on the seat 23 at a suitable height and squat down and prop up.

2. Besides, the user may step on the first pedal 34 and the second pedal 35 in a same direction or in opposite directions for stretching the calves. During the process, swinging angles and velocities may be detected and transmitted to the display 13 by the two angle sensors 40.

3. The exercise device of the present invention is easy to operate, and provides multifunctional exercising effect.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An exercise device for deep squat and body stretch, and the exercise device comprising:

a device body having a base and two handles;

a damping assembly having a tube mounted uprightly on the base and having a side wall;

an interior space formed inside the side wall of the tube;

two ends, one of the two ends connected to the base, and the other one of the two ends having an opening;

a positioning socket disposed on the side wall of the tube and communicating with the interior space;

an adjusting component mounted with the positioning socket, having two ends, and one of the two ends of the adjusting component extending into the interior space; and a guiding slot disposed on the side wall of the tube and communicating with the interior space;

a pneumatic cylinder inserted into the tube and having a cylinder body having a side wall;

multiple positioning through holes disposed on the side wall of the cylinder body and arranged in an axial direction of the cylinder body, wherein the adjusting component of the tube is configured to be mounted with one of the multiple positioning through holes; and a guiding post protruding on the side wall of the cylinder body and extending into the guiding slot; and a piston rod having a free end; and a seat connected to the free end of the piston rod;

a pedal set having a supporting stand connected to the base;

an axle assembled on the supporting stand and having two ends;

a first supporting rod protruding from the base below one of the two ends of the axle;

a second supporting rod protruding from the base below the other one of the two ends of the axle;

a first pedal mounted to the axle and having a first pedal rod;

a second pedal mounted to the axle and having a second pedal rod; and multiple elastic rings, at least one of the multiple elastic rings connected between the first supporting rod and the first pedal rod, and at least another one of the multiple elastic rings connected between the second supporting rod and the second pedal rod; and two angle sensors, one of the two angle sensors mounted on the first pedal rod at a spaced interval from the axle, and the other one of the two angle sensors mounted on the second pedal rod at a spaced interval from the axle.

2. The exercise device for deep squat and body stretch as claimed in claim 1, wherein the positioning socket has a threaded hole disposed through the positioning socket, the adjusting component is an adjusting bolt and is configured to be mounted with the threaded hole of the positioning socket, the adjusting bolt has two ends and a positioning post connected to one of the two ends of the adjusting bolt, and the positioning post is able to extend into the tube through one of the multiple positioning through holes.

3. The exercise device for deep squat and body stretch as claimed in claim 1, wherein:

the base has a front bar located at a front side of the base; and a rear bar located at a rear side of the base, and having a top side and a bottom side;

the device body has a standing frame connected with the base and having two sides, and the two handles are respectively disposed disposed on the two sides of the standing frame;

the tube of the damping assembly is connected to the front bar; and the supporting stand of the pedal set is connected to the top side of the rear bar, and the first supporting rod and the second supporting rod are connected to the bottom side of the rear bar.

4. The exercise device for deep squat and body stretch as claimed in claim 2, wherein:

the base has a front bar located at a front side of the base; and a rear bar located at a rear side of the base, and having a top side and a bottom side;

the device body has a standing frame connected with the base and having two sides, and the two handles are respectively disposed on the two sides of the standing frame;

the tube of the damping assembly is connected to the front bar; and the supporting stand of the pedal set is connected to the top side of the rear bar, and the first supporting rod and the second supporting rod are connected to the bottom side of the rear bar.

5. The exercise device for deep squat and body stretch as claimed in claim 3, wherein:

each one of the first pedal rod and the second pedal rod has an axle socket;

the axle socket of the first pedal rod is pivotally connected with one of the two ends of the axle; and the axle socket of the second pedal rod is pivotally connected with the other one of the two ends of the axle.

6. The exercise device for deep squat and body stretch as claimed in claim 4, wherein:

each one of the first pedal rod and the second pedal rod has an axle socket;

the axle socket of the first pedal rod is pivotally connected with one of the two ends of the axle; and the axle socket of the second pedal rod is pivotally connected with the other one of the two ends of the axle.

7. The exercise device for deep squat and body stretch as claimed in claim 5, wherein:

the first pedal rod has two first connecting bars disposed at a spaced interval;

the first supporting rod has two first hitching bars disposed at a spaced interval;

two of the multiple elastic rings are connected between the first supporting rod and the first pedal rod, and each one of said two elastic rings connected between the first supporting rod and the first pedal rod is sheathed on a respective one of the two first connecting bars and a respective one of the two first hitching bars;

the second pedal rod has two second connecting bars disposed at a spaced interval;

the second supporting rod has two second hitching bars disposed at a spaced interval; and another two of the multiple elastic rings are connected between the second supporting rod and the second pedal rod, and each one of said another two elastic rings connected between the second supporting rod and the second pedal rod is sheathed on a respective one of the two second connecting bars and a respective one of the two second hitching bars.

8. The exercise device for deep squat and body stretch as claimed in claim 6, wherein:

the first pedal rod has two first connecting bars disposed at a spaced interval;

the first supporting rod has two first hitching bars disposed at a spaced interval;

two of the multiple elastic rings are connected between the first supporting rod and the first pedal rod, and each one of said two elastic rings connected between the first supporting rod and the first pedal rod is sheathed on a respective one of the two first connecting bars and a respective one of the two first hitching bars;

the second pedal rod has two second connecting bars disposed at a spaced interval;

the second supporting rod has two second hitching bars disposed at a spaced interval; and another two of the multiple elastic rings are connected between the second supporting rod and the second pedal rod, and each one of said another two elastic rings connected between the second supporting rod and the second pedal rod is sheathed on a respective one of the two second connecting bars and a respective one of the two second hitching bars.

9. The exercise device for deep squat and body stretch as claimed in claim 7, wherein the standing frame has a display, and the two angle sensors are able to transmit signals of sensed angles to the display.

10. The exercise device for deep squat and body stretch as claimed in claim 8, wherein the standing frame has a display, and the two angle sensors are able to transmit signals of sensed angles to the display.

* * * * *